US011359849B2

(12) United States Patent
Saito et al.

(10) Patent No.: US 11,359,849 B2
(45) Date of Patent: Jun. 14, 2022

(54) ICE MAKING DEVICE

(71) Applicant: NIDEC SANKYO CORPORATION, Nagano (JP)

(72) Inventors: Shunji Saito, Nagano (JP); Takaji Harata, Nagano (JP); Katsuhiko Hayashi, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 193 days.

(21) Appl. No.: 16/746,966

(22) Filed: Jan. 20, 2020

(65) Prior Publication Data

US 2020/0240695 A1 Jul. 30, 2020

(30) Foreign Application Priority Data

Jan. 28, 2019 (JP) ..... JP2019-012390

(51) Int. Cl.
*F25C 1/04* (2018.01)
*F25C 5/04* (2006.01)

(52) U.S. Cl.
CPC ..... *F25C 1/04* (2013.01); *F25C 5/04* (2013.01); *F25C 2400/14* (2013.01)

(58) Field of Classification Search
CPC ..... F25C 1/25; F25C 2400/14
See application file for complete search history.

(56) References Cited

U.S. PATENT DOCUMENTS 4,306,423 A * 12/1981 Webb ..... F25C 5/06 249/66.1
6,044,658 A * 4/2000 Ryu ..... F25C 1/04 62/353
6,637,217 B2 10/2003 Kim et al.
7,010,934 B2 * 3/2006 Choi ..... F25C 1/10 62/353
7,841,203 B2 * 11/2010 Yoon ..... F25C 1/04 62/344
7,934,389 B2 * 5/2011 Yoon ..... F25C 1/25 62/344

(Continued)

FOREIGN PATENT DOCUMENTS

CN 1269496 10/2000
CN 1363813 8/2002

(Continued)

OTHER PUBLICATIONS

Machine Translation of CN 102192625 to Marutani et al. eSpacenet, description; Sep. 2011 (Year: 2011).*

(Continued)

*Primary Examiner* — Filip Zec
(74) *Attorney, Agent, or Firm* — JCIPRNET

(57) ABSTRACT

An ice making device includes an ice tray, an ice separating mechanism which is a mechanism structured to take out ice pieces from the ice tray, a drive part structured to drive the ice separating mechanism, and a frame which supports the ice tray and the drive part. The frame is provided with a water passage part which guides water supplied from an outside to the ice tray, and the frame is attached with a water supply adaptor which is a water passage member separately provided from the water passage part for supplying the water to the water passage part.

6 Claims, 8 Drawing Sheets

(56) References Cited

U.S. PATENT DOCUMENTS

| | | | |
|---|---|---|---|
| 9,032,746 | B2 | 5/2015 | Ito et al. |
| 2008/0053112 | A1 | 3/2008 | Higashitani et al. |
| 2009/0178428 | A1 | 7/2009 | Cho et al. |
| 2015/0241102 | A1 | 8/2015 | Lee et al. |

FOREIGN PATENT DOCUMENTS

| | | |
|---|---|---|
| CN | 1993589 | 7/2007 |
| CN | 101487651 | 7/2009 |
| CN | 102192625 | 9/2011 |
| CN | 102735001 | 10/2012 |
| EP | 2080968 | 7/2009 |
| JP | 2008057897 | 3/2008 |
| JP | 2012207824 | 10/2012 |
| JP | 2014105946 | 6/2014 |
| KR | 101407003 | 6/2014 |

OTHER PUBLICATIONS

Office Action of China Counterpart Application, with English translation thereof, dated Jul. 1, 2021, pp. 1-15.

* cited by examiner

ICE MAKING DEVICE

CROSS REFERENCE TO RELATED APPLICATION

The present invention claims priority under 35 U.S.C. § 119 to Japanese Application No. 2019-012390 filed Jan. 28, 2019, the entire content of which is incorporated herein by reference.

TECHNICAL FIELD

The present invention relates to an automatic ice making technique, and specifically, an ice making device structured to receive water supplied from the outside to form ice pieces.

BACKGROUND

In Japanese Patent Laid-Open No. 2012-207824 (Patent Literature 1), an ice making device is disclosed in which ice pieces are formed with an ice tray having a plurality of divided cells and the ice tray is twisted to take out the ice pieces. In the ice making device disclosed in Patent Literature 1, water supplied from the outside is directly poured into the ice tray.

In an ice making device installed in a freezing chamber, water for forming ice pieces is commonly supplied from a host apparatus such as a refrigerator-freezer. In this case, for example, when a water supply port is required to provide in the ice making device so as to protrude from a frame of the ice making device to an outer side, the freezing chamber to which the ice making device is applicable is restricted due to a position of the water supply port and thus, versatility of the ice making device is impaired.

In view of the problem described above, an objective of the present invention is to provide an ice making device which is applicable to various freezing chambers while providing with a water supply structure which is protruded to an outer side from a frame of the ice making device.

SUMMARY

To achieve the above mentioned objective, the present invention provides an ice making device including an ice tray, an ice separating mechanism which is a mechanism structured to take out ice pieces from the ice tray, a drive part structured to drive the ice separating mechanism, and a frame which supports the ice tray and the drive part. The frame is provided with a water passage part which guides water supplied from an outside to the ice tray, and the frame is attached with a water supply adaptor which is a water passage member separately provided from the water passage part for supplying the water to the water passage part.

A water passage for connecting a water passage part provided in the frame with a water supply source is structured of a water supply adapter which is separately formed from the frame and thus, only by changing or exchanging the water supply adapter, the ice making device in accordance with the present invention can be applied to various freezing chambers.

In the present invention, it is preferable that the water supply adapter is provided with a water discharge part which is disposed on the water passage part and a water receiving part which is disposed so as to protrude from the frame to an outer side. Even in a case that a water receiving part is protruded from the frame to an outer side, when the water supply adapter is changed or exchanged, the ice making device in accordance with the present invention can be applied to various freezers.

In the present invention, it is preferable that the water supply adapter is capable of being attached to a plurality of different positions on the frame. Since the water supply adapter can be attached to a plurality of positions, when the position of the water supply adapter is changed, the ice making device in accordance with the present invention can be applied to freezing chambers of different specifications.

In the present invention, it is preferable that the water passage part is provided with a water passage port through which the water is poured into the ice tray and a slope which is an inclined face for sending the water to the water passage port, and the water supply adapter supplies the water to the slope. Since the water passage part is provided with a slope, even when the water is supplied anywhere on the slope from the water supply adapter, the water can be guided to the water passage port. As a result, a degree of freedom of an attaching position of the water supply adapter is enhanced.

In the present invention, it is preferable that the water supply adapter is structured so that an attaching position of the water supply adapter to the frame is capable of sliding along the slope. Since the water supply adapter is structured to be slidable along the slope and thus, an attaching position of the water supply adapter can be flexibly adjusted according to a specification of a freezing chamber.

Further, the ice making device in accordance with the present invention may be structured that the water passage part is further provided with a water supply port which is a water passage protruded to an outer side of the frame from a middle of the slope, and the water supply adapter is attached to an upstream side of the slope with respect to a position where the water supply port is formed. Since the slope of the water passage part is further extended to an upstream side with respect to a position of the water supply port provided in the water passage part, for example, the ice making device can be selectively used so that, in a freezing chamber assumed as a main model, the ice making device is installed without using the water supply adapter and, for other models, the water supply adapter is used.

In the present invention, it is preferable that the water passage part is provided with a side wall part which is a side wall of a water passage, the ice making mechanism includes the drive part structured to turn the ice tray to be reversed, and a block part structured to contact with a part of the ice tray during turning and obstruct partly the turning of the ice tray, and the water passage part and the block part are integrated with the frame and the block part is provided under the water passage part. In the ice making device in which a part of the ice tray is contacted with the frame to twist the ice tray and take out ice pieces, when the ice tray is twisted, a considerable force is applied to the frame. Since the side wall part of the water passage part and the block part are disposed in the upper and lower direction, rigidity of the face where the block part is provided is increased and distortion of the frame due to pressing of the ice tray against the block part is reduced.

In the present invention, it is preferable that the water supply adapter is provided with an arm part which is elastically deformable, the arm part is provided with a first fitting part which is a hook, a hole or a recessed part, the frame is provided with a second fitting part in a shape to be paired with the first fitting part, and the water supply adapter is attached to the frame by fitting the first fitting part and the second fitting part to each other. Since the water supply adapter is attached to the frame by using a so-called snap fitting structure, the water supply adapter can be attached to and detached from the frame simply and easily.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

Effects of the Invention

As described above, according to the ice making device in the present invention, the ice making device can be applied to various freezing chambers even when the ice making device is provided with the water supply structure which is protruded to an outer side from the frame of the ice making device.

Other features and advantages of the invention will be apparent from the following detailed description, taken in conjunction with the accompanying drawings that illustrate, by way of example, various features of embodiments of the invention.

An embodiment of an ice making device in accordance with the present invention will be described below with reference to the accompanying drawings. An ice making device "U" described below is a device which is installed in a freezing chamber of a refrigerator-freezer that is a host apparatus not shown, and the ice making device "U" is supplied with water from the refrigerator-freezer to automatically make ice pieces.

An "upper and lower" direction in the following descriptions means a parallel direction to the "Z"-axis of coordinate axes indicated in respective figures, and the "Z1" side is an "upper" side and the "Z2" side is a "lower" side. A "front and rear" direction means a parallel direction to the "X"-axis of the coordinate axes, and the "X1" side is a "front" side and the "X2" side is a "rear" side. Similarly, a "right and left" direction means a parallel direction to the "Y"-axis of the coordinate axes, and the "Y1" side is a "right" side and the "Y2" side is a "left" side. Further, a "horizontal" direction means an "X-Y" plane direction shown by the coordinate axes.

(Schematic Structure)

Figure 1:
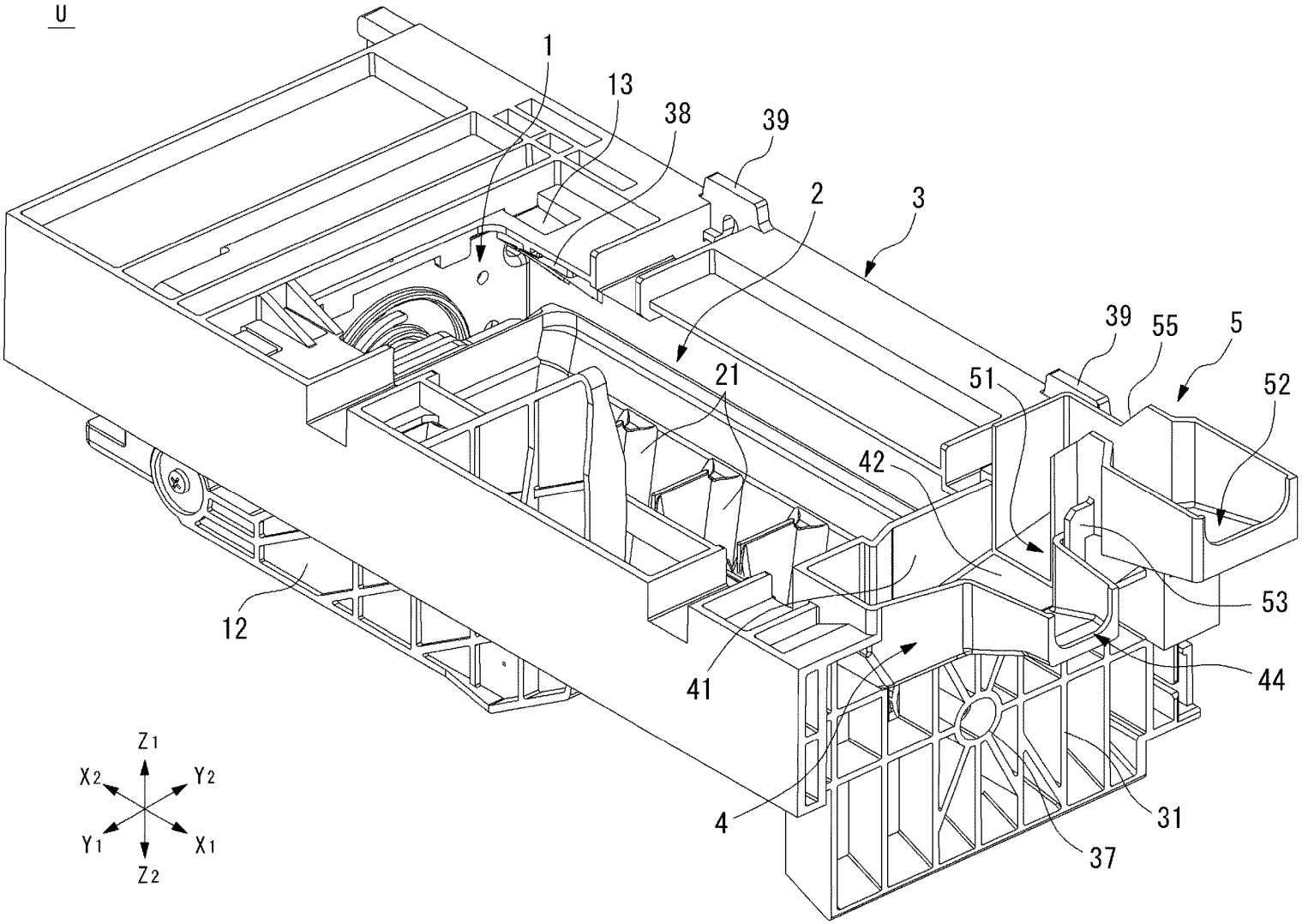
FIG. 1 is a perspective view showing an outward appearance of an ice making device in accordance with an embodiment of the present invention.
Figure 2:
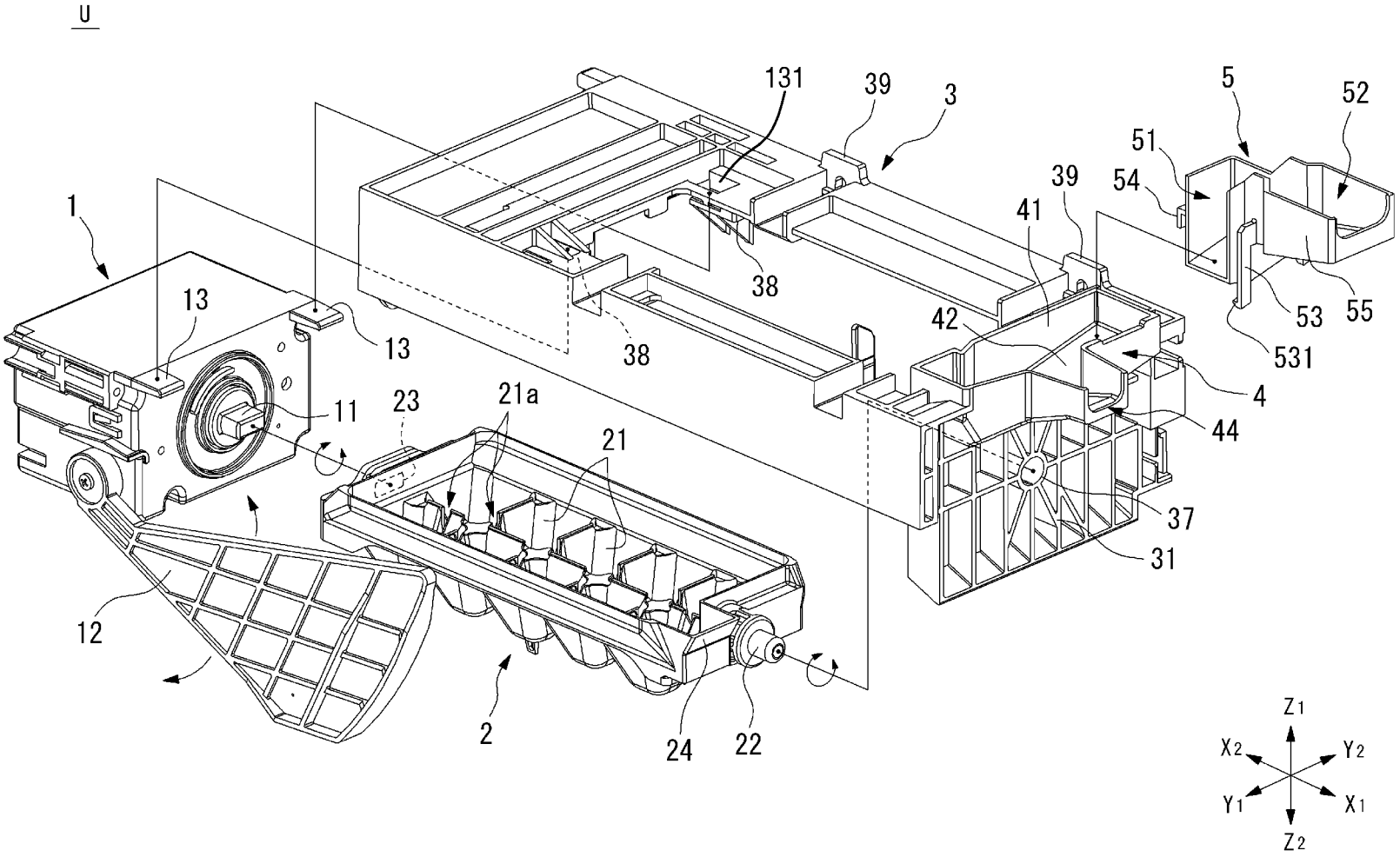
FIG. 2 is an exploded perspective view showing an ice making device in accordance with an embodiment of the present invention.

FIG. 1 is a perspective view showing an outward appearance of an ice making device "U". FIG. 2 is an exploded perspective view showing the ice making device "U". The ice making device "U" is mainly structured of an ice tray 2, a drive unit 1 which is a drive part structured to turn the ice tray 2, a frame 3 which supports the ice tray 2 and the drive unit 1, and a water supply adapter 5 which is a water passage member separately provided and attached to the frame 3.

The ice making device "U" in this embodiment is a so-called "twist type" ice making device. A freezing chamber in which the ice making device "U" is installed is disposed with an ice storage container not shown under the ice making device "U". The ice making device "U" takes out ice pieces from the ice tray 2 by twisting the ice tray 2 to drop them into an ice storage container. In the following descriptions, an operation for taking out ice pieces from the ice tray 2 is referred to as an "ice separating operation", and a mechanism for taking out the ice pieces from the ice tray 2 is referred to as an "ice separating mechanism". Although described in detail below, the ice separating mechanism of the ice making device "U" in this embodiment is structured of a drive unit 1 and a block part 321 (see FIGS. 7A and 7B) provided in the frame 3.

In the refrigerator-freezer which is a host apparatus, water is supplied to the water supply adapter 5 of the ice making device "U", and the supplied water is passed from the water supply adapter 5 through the water passage part 4 provided on an upper face of the frame 3 and filled in the ice tray 2. A control device which is mounted on the refrigerator-freezer monitors temperature of the ice tray 2 with a thermistor attached to its under face and, when the temperature of the ice tray 2 having reached a predetermined value is detected, the ice tray 2 is twisted and ice pieces are taken out. After the ice separating operation has been completed and, when the ice tray 2 is returned to an original horizontal position, the refrigerator-freezer fills the ice tray 2 with water again.

(Drive Unit)

The drive unit 1 is a motor unit having a motor which is a drive source. A front face of the drive unit 1 is provided with an output shaft 11 which is a non-circular shaft body to be fitted to a rear face of the ice tray 2 so as to protrude to the front side.

A face on the right side ("Y1" side) of the drive unit 1 is attached with an ice detection arm 12 which is an arm member for detecting an ice quantity in an inside of the ice storage container. The ice detection arm 12 is a plate-shaped member in a substantially fan shape when viewed from a side which is gradually expanded from its base end part toward its tip end in the upper and lower direction. The base end part of the ice detection arm 12 is connected with the drive unit 1, and the drive unit 1 turns the ice detection arm 12 in the upper and lower direction with the base end part of the ice detection arm 12 as a center. When an ice separating operation is started, the drive unit 1 lowers the ice detection arm 12 to an inside of the ice storage container before ice pieces are taken out from the ice tray 2 and detects an ice quantity in the inside of the ice storage container. After having confirmed that there is an enough vacant space in the ice storage container, the ice separating operation is continued.

A fitting piece 13 which is a protruded part in a flat plate shape is protruded to the front side from both ends on the right and left sides of an upper face of the drive unit 1. The frame 3 is provided with fitted slots 131 which are recessed parts corresponding to the shape of the fitting piece 13. The drive unit 1 is fixed to a rear end portion of the frame 3 by inserting the fitting pieces 13 into the fitted slots 131 of the frame 3.

(Ice Tray)

The ice tray 2 is a water storage container made of resin which is elastically deformable. The ice tray 2 is divided into a plurality of cells 21. A front end of a right side ("Y1" side) half body of the ice tray 2 is provided with a water receiving part 24 that is a water poured part which is projected to the front side with respect to the cell 21. Water supplied from the water supply adapter 5 is poured into the water receiving part 24 of the ice tray 2 through the water passage part 4. Each of the cells 21 is formed with slits 21*a* which communicate a space within the cell with a space within the cell 21 adjacent to the front and back direction or the right and left direction and thereby the water poured into the water receiving part 24 is equally supplied to all the cells 21.

A rear face of the ice tray 2 is formed with a shaft hole 23 whose shape is the same as the output shaft 11 of the drive unit 1, and the output shaft 11 is fitted into the shaft hole 23 to turn the ice tray 2 together with turning of the output shaft 11. A front face of the ice tray 2 is provided with a shaft part 22 which is a shaft body projected to the front side, and the shaft part 22 is turnably supported by a bearing part 37 formed in the frame 3.

(Frame)

The frame 3 is a frame body which supports the drive unit 1 and the ice tray 2 and to which the water supply adapter 5 is attached. An end part on the left side ("Y2" side) in an upper face of the frame 3 is provided with two attaching parts 39 for fixing the ice making device "U" to a wall face of the freezing chamber with a screw.

The frame 3 is provided with a wall part 31 which is a plate-shaped part structuring a front face of the frame 3. A thickness of the wall part 31 is removed in a lattice shape and an upper part of the wall part 31 is formed with a water passage part 4 for guiding water supplied from the water supply adapter 5 to the ice tray 2. A bearing part 37 which supports the shaft part 22 of the ice tray 2 is formed so as to penetrate through the wall part 31 in the front and rear direction.

(Water Passage Part)

Figure 3:
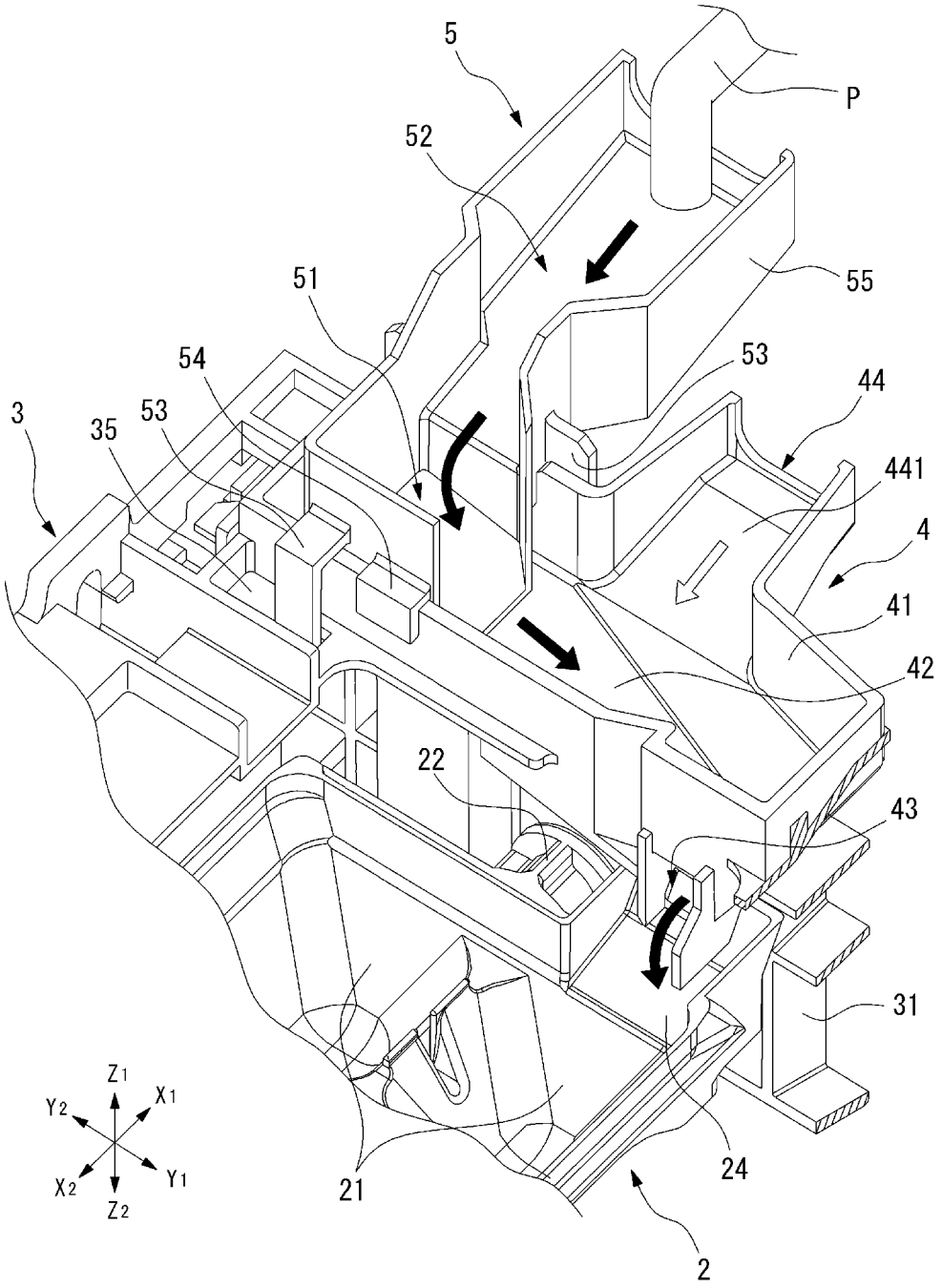
FIG. 3 is a perspective view showing an outward appearance of a water passage part.
Figure 4:
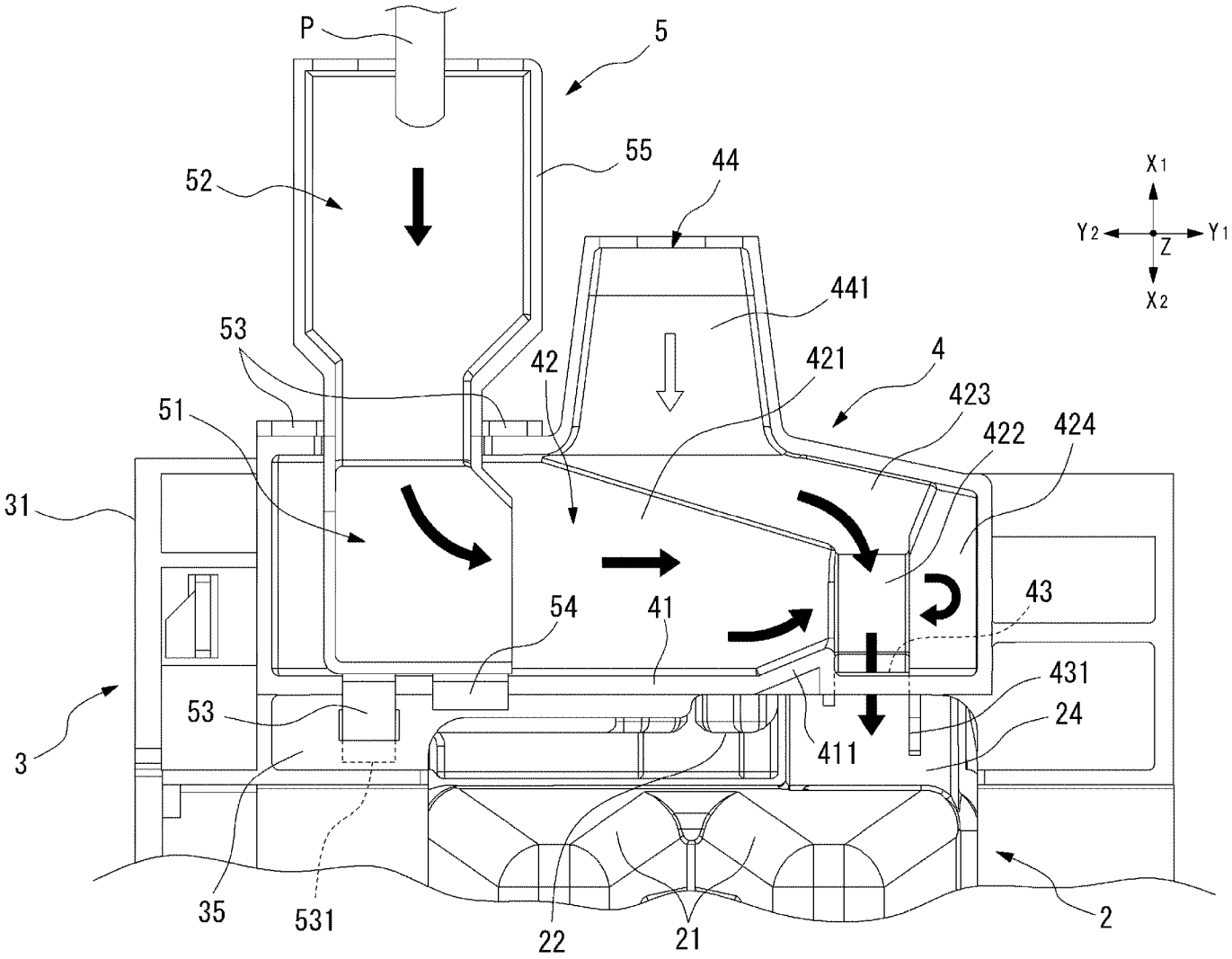
FIG. 4 is a plan view showing a rectification structure of a water passage part.

FIG. 3 is a perspective view showing an outward appearance of the water passage part 4. FIG. 4 is a plan view showing a rectification structure of the water passage part 4. The water passage part 4 of the ice making device "U" will be described below with reference to FIGS. 3 and 4.

The water passage part 4 in this embodiment is a part of the wall part 31 of the frame 3 and structures the upper part of the wall part 31. The water passage part 4 is a water passage which guides the water supplied from the water supply adapter 5 to the ice tray 2.

The water passage part 4 in this embodiment is provided with a water passage port 43 which is an opening part for pouring water into the ice tray 2, and a slope 42 which is an inclined face for sending water to the water passage port 43. Further, the water passage part 4 is surrounded by a side wall part 41 which is a side wall partitioning the water passage and, as a result, the water passage part 4 is formed with a water passage in a recessed groove shape in which its upper side is opened.

The slope 42 in this embodiment is an inclined face extended in the right and left direction so that the left side ("Y2" side) is an upstream side and the right side ("Y1" side) is a downstream side. The water supply adapter 5 supplies water to the slope 42, the water poured into the slope 42 flows down the slope 42 to reach the water passage port 43, and the water is flowed into the water receiving part 24 of the ice tray 2 through the water passage port 43.

As shown in FIG. 4, the slope 42 in this embodiment is provided with a main slope 421, a drainage part 422, a first rectification part 423 and a second rectification part 424.

The main slope 421 is a main part of the slope 42 and is an inclined face which is extended from an end part on an upstream side of the slope 42 toward a downstream side. In this embodiment, the water supply adapter 5 is attached to an end part on an upstream side of the main slope 421, and water supplied from the outside is poured into the main slope 421 through the water supply adapter 5.

The drainage part 422 is an inclined face which is continuously provided on a downstream side of the main slope 421. The drainage part 422 is provided so that its face position becomes lower in a step shape from the main slope 421 and is gradually inclined so as to be lowered from the front side ("X1" side) to the rear side ("X2" side). A downstream side of the drainage part 422 is connected with the water passage port 43.

The slope 42 in this embodiment changes a flow of the water flowing from the main slope 421 to the right direction ("Y1" direction) to a flow of the water toward the rear side ("X2" direction) by the drainage part 422 to drain the water through the water passage port 43. Therefore, in a case that the water having inertia to the right direction ("Y1" direction) reaches the water passage port 43, the water may not be poured into the water receiving part 24 of the ice tray 2 through the water passage port 43 and may be flowed from the water passage port 43 to the right direction ("Y1" direction). Especially, the water passage port 43 in this embodiment is a hole which is directly formed in the side wall part 41 of the slope 42, and the water passage part 4 in this embodiment is not provided with a surplus water passage for stabilizing the flow of the water whose direction is changed by the drainage part 422.

Therefore, the slope 42 in this embodiment is provided with a first rectification part 423 and a second rectification part 424 as a rectification structure for eliminating inertia to the right direction ("Y1" direction) of a flow of the water and preventing the water from leaking to the right direction ("Y1" direction) from the water passage port 43.

The first rectification part 423 is an inclined face which is inclined so as to become lower toward the rear side ("X2" side) and send the water to flow backward ("X2" direction) with respect to the drainage part 422. The first rectification part 423 is formed so that a water passage width of the main slope 421 is gradually narrowed from the front side ("X1" side) and from a middle of the main slope 421 toward the downstream side. As a result, a flow of a part of the water flowed through the main slope 421 is corrected to the rear side ("X2" direction), and the water flowing to the rear side ("X2" direction) is poured to an end part on the front side ("X1" side) of the drainage part 422.

The second rectification part 424 is a steep inclined face which is formed on the right side ("Y1" side) with respect to the drainage part 422. The second rectification part 42 is formed so as to become lower toward the left side ("Y2" side), in other words, become lower toward the drainage part 422 side. The water flown over the drainage part 422 by momentum from the main slope 421 and collided with the second rectification part 424 is poured into the drainage part 422 so as to flow backward to a flow of the water of the main slope 421.

As described above, the inertia to the right direction ("Y1" direction) of the water flowed into the drainage part 422 from the main slope 421 is canceled by the water flowed into the drainage part 422 from the first rectification part 423 and the second rectification part 424. As a result, the water flowed through the water passage port 43 is rectified and leakage of the water to the right direction ("Y1" direction) is suppressed.

In addition, the side wall part 41 of the water passage part 4 in this embodiment is provided with a guide part 411 for ensuring rectifying effects by the first rectification part 423 and the second rectification part 424. The guide part 411 is a portion of the side wall part 41 which is adjacent to the left side ("Y2" side) of the water passage port 43, and the guide part 411 prevents the water flowed through the main slope 421 from passing through the drainage part 422 and leaking out to the right direction ("Y1" direction) from the water passage port 43. An inner wall face of the guide part 411 is formed so as to gradually project to the front side ("X1" direction) toward the downstream side of the main slope 421. Therefore, the water flowed through the main slope 421 is guided to a direction going away from the water passage port 43 by the guide part 411 and sufficiently mixed with the water flowed to the drainage part 422 through the first rectification part 423 and the second rectification part 424.

In addition, an outlet of the water passage port 43 is formed on the right side ("Y1" side) with a waterproof wall 431 which is a plate-shaped part structured to prevent the ejected water from splashing to the right side ("Y1" side).

Further, the water passage part 4 in this embodiment is formed with a water supply port 44 which is a water passage separately provided from the water supply adapter 5 so as to be protruded to the front side ("X1" direction) from a middle of the slope 42. Water supplied to the water supply port 44 from the outside is poured into the slope 42 through an inclined face 441. In this embodiment, the water supply port 44 is not utilized and water supplied from the outside is poured into the main slope 421 through the water supply adapter 5. The ice making device "U" in this embodiment can be installed in a freezing chamber which is assumed to be a main model without using the water supply adapter 5 and, when the ice making device "U" is to be applied to a model other than the main model, the water supply adapter 5 is used. In other words, a refrigerator-freezer for this embodiment is another model other than the assumed main model.

In accordance with an embodiment of the present invention, the water passage part 4 may be provided with no water supply port 44 and structured so that the water supply adapter 5 is always used to supply water to the water passage part 4. In this case, the frame 3 may be structured so that the water supply adapter 5 is also attached to a position of the water supply port 44. When the frame 3 is structured so that the water supply adapter 5 can be attached to the frame 3 at a plurality of different positions, the ice making device "U" can be applied to a freezing chamber of a different specification by appropriately changing the position of the water supply adapter 5. Further, even in a case that the water supply adapter 5 supplies water to any position on the slope 42, the water is guided to the water passage port 43. Therefore, a degree of freedom for an attaching position of the water supply adapter 5 is enhanced.

(Water Supply Adapter)

Figure 5:
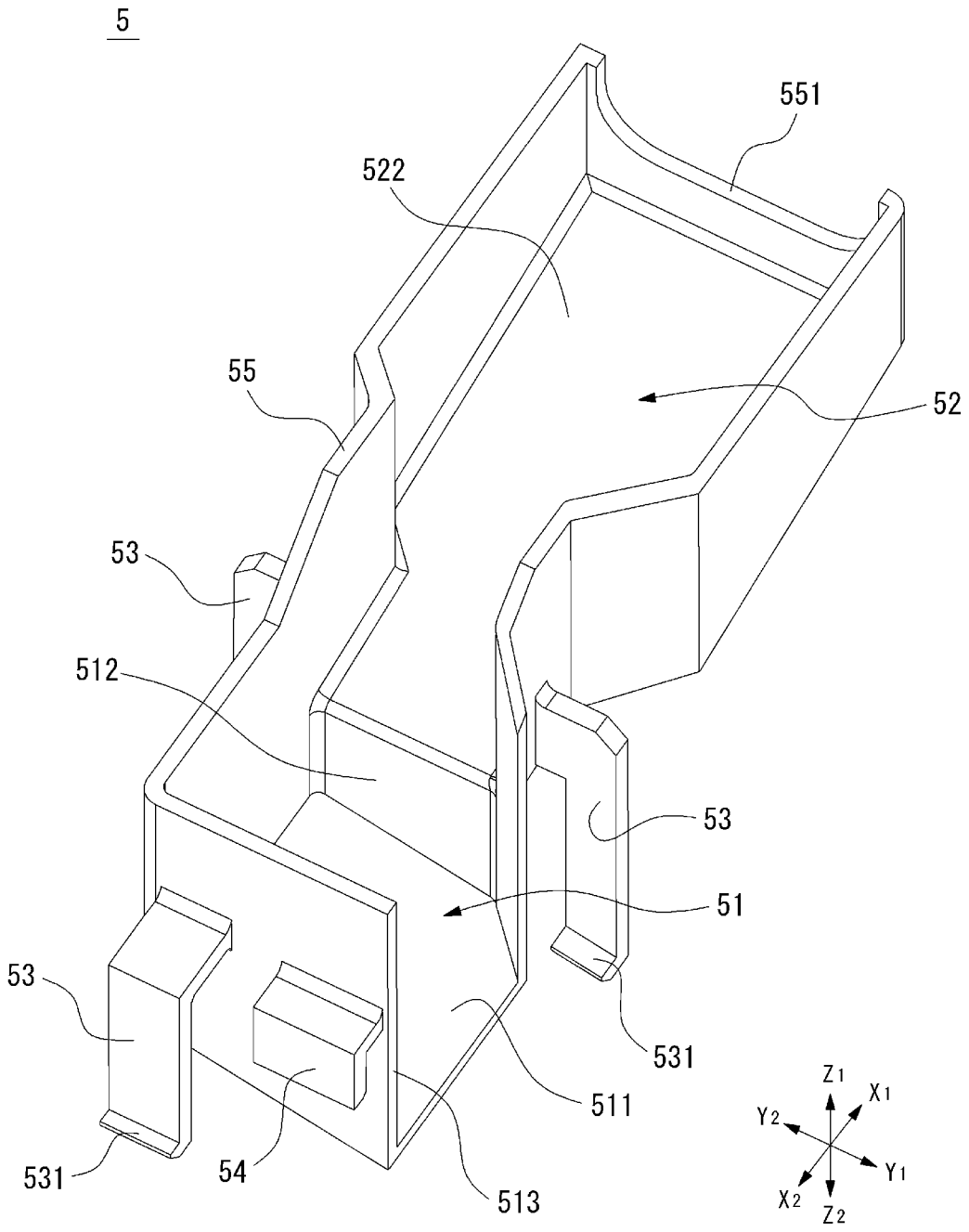
FIG. 5 is a perspective view showing a structure of a water supply adapter.
Figure 6:
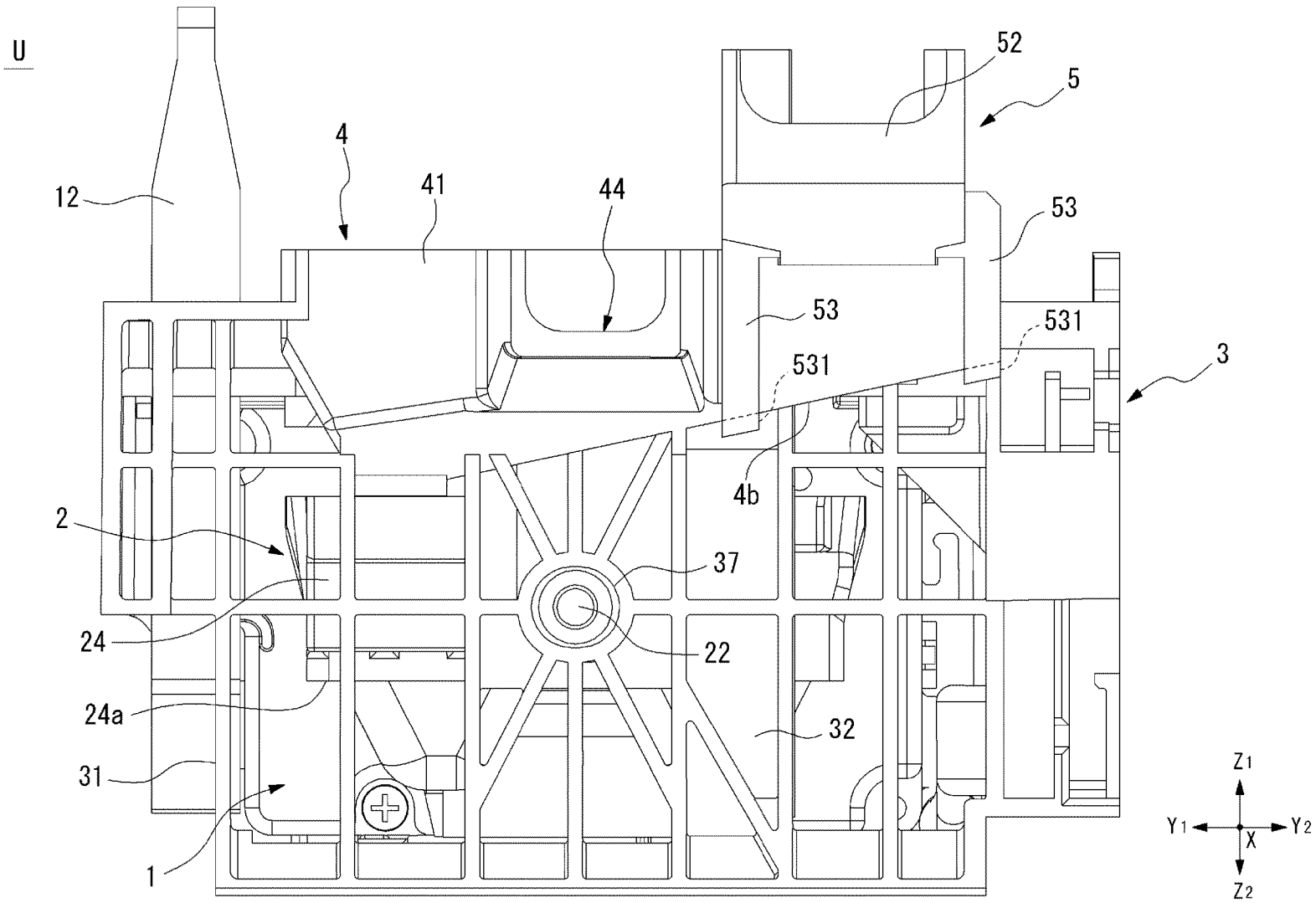
FIG. 6 is a front view showing an ice making device in accordance with an embodiment of the present invention.

FIG. 5 is a perspective view showing a structure of the water supply adapter 5. FIG. 6 is a front view showing the ice making device "U". A structure of the water supply adapter 5 will be described below with reference to FIGS. 3 through 6.

The water supply adapter 5 is mainly structured of a water discharge part 51 installed on the main slope 421 and a water receiving part 52 which is disposed so as to protrude to the front side ("X1" direction) from the frame 3. A boundary between the water discharge part 51 and the water receiving part 52 is not strictly determined. The water discharge part 51 means a portion which discharges water to the water passage part 4, and the water receiving part 52 means a portion which receives water supplied from the outside.

The water receiving part 52 is provided with an inclined face 522 which is its bottom face and becomes lower toward the water discharge part 51 side ("X2" side). The water discharge part 51 is provided with an inclined face 511 which is its bottom face and becomes lower toward the downstream side ("Y1" side) of the slope 42. A step face 512 which is a vertical face is provided between the inclined face 522 of the water receiving part 52 and the inclined face 511 of the water discharge part 51. Therefore, the inclined face 511 of the water discharge part 51 is set to be lower in a step shape than the inclined face 522 of the water receiving part 52. The step face 512 is provided for lowering the water discharge part 51 to a position near to a face of the slope 42. The inclined faces 511 and 522 of the water supply adapter 5 is surrounded by the side wall part 55 which is a side wall partitioning a water passage and thereby, the water supply adapter 5 structures a water passage in a recessed groove shape whose upper side is opened.

As shown in FIG. 5, the step face 512 of the water supply adapter 5 is disposed so as to be parallel to the side wall part 41 along the side wall part 41 of the slope 42. More specifically, the water supply adapter 5 is attached to an end part on the upstream side of the main slope 421 and is disposed so that a face on the rear side ("X1" side) of the step face 512 is located at a position contacting or approaching the side wall part 41 on the front side ("X1" side) of the main slope 421. Similarly, in the side wall part 55 partitioning the water discharge part 51 of the water supply adapter 5, the side wall part 55 structuring a face on an opposite side to the step face 512 is disposed at a position contacting or approaching the side wall part 41 on the rear side ("X2" side). As a result, a width in the front and rear direction ("X" direction) of the water discharge part 51 of the water supply adapter 5 is secured widely to the maximum and the water flowed into the water discharge part 51 through the water receiving part 52 is prevented from splashing by colliding with the side wall part 41 on an opposite side to the step face 512.

The water receiving part 52 is formed with a cut-out part 551 in the side wall part 55 closing an end part on a side in an extending direction of the water receiving part 52 and a water supply pipe "P" of the refrigerator-freezer is disposed in the cut-out part 551. A water passage width on a downstream side of the water receiving part 52 is gradually narrowed toward an upstream side of the water discharge part 51, and water supplied to the water receiving part 52 is sent to the upstream side of the water discharge part 51. The water supplied to the water discharge part 51 flows down the inclined face 511 of the water discharge part 51 and flows out to the slope 42 from the water discharge port 513 that is an opening part.

Further, an outer face of the side wall part 55 of the water supply adapter 5 is formed with arm parts 53 which are extended to the lower side so as to be elastically deformable. Each of tip ends of the arm parts 53 is formed with a hook 531 (first fitting part) which is protruded to the rear side ("X2" direction), and the water supply adapter 5 is attached to the frame 3 by engaging the hook 531 with the frame 3.

More specifically, in an outer face of the side wall part 55 of the water supply adapter 5, each of right and left outer faces on a slightly water receiving part 52 side with respect to the water discharge part 51 is formed with one arm part 53. Further, a face on the rear side ("X2" side) of the water supply adapter 5 is formed with one arm part 53 and one arm part 54 which is bent to the lower side and is provided with no hook part. As shown in FIG. 6, the arm parts 53 provided on the right and left faces of the water supply adapter 5 are formed so that the arm part 53 on the left side ("Y2" side) is short and the arm part 53 on the right side ("Y1" side) is long so as to be along an under face 4*b* of the slope 42 of the water passage part 4. The hooks 531 of these arm parts 53 are also obliquely formed so as to be coincided with an inclination of the under face 4*b* (second fitted part) of the slope 42. On the other hand, regarding the arm part 53 and the arm part 54 formed on the face on the "X2" side of the water supply adapter 5, as shown in FIG. 3, the arm part 53 is passed through a hole provided in the rib 35 formed along the side wall part 41 of the water passage part 4, and the hook 531 is engaged with a back side (second fitting part) of the rib 35. The arm part 54 is hanged on the side wall part 41 of the water passage part 4 and is engaged with the side wall part 41 and thereby the water supply adapter 5 is prevented from inclining to the lower side ("Z2" direction) and the front side ("X1" direction).

The water supply adapter 5 in this embodiment is attached to the frame 3 by engaging the hooks 531 with corresponding portions to be paired with the hooks 531 of the frame 3. As a result, the water supply adapter 5 can be simply and easily attached to and detached from the frame 3. In accordance with an embodiment of the present invention, the first fitting part in the present invention is not limited to a shape of the hook 531. For example, it may be structured that a hole or a recessed part which is provided at a tip end of the arm part 53 is fitted to a second fitting part provided in the frame 3 which has a shape to be paired with the hole or the recessed part.

As described above, in the ice making device "U" in this embodiment, a water passage connecting the water passage part 4 provided in the frame 3 with the refrigerator-freezer which is a supply source of water is structured of the water supply adapter 5 which is separately provided from the frame 3. Therefore, even in a case that a water passage which is protruded from the frame 3 to an outer side is required to provide on the ice making device "U", when the water supply adapter 5 is changed or exchanged, the ice making device "U" can be applied to various refrigerator-freezers.

(Ice Separating Operation)

Figure 7A:
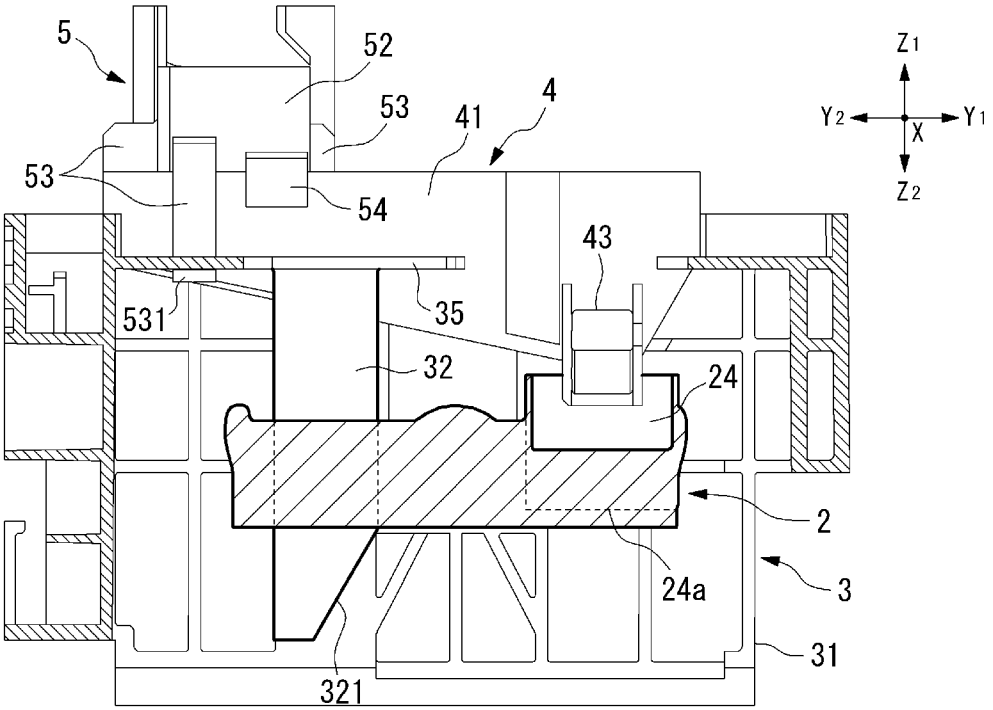
FIG. 7A and FIG. 7B are cross-sectional views for explaining an ice separating operation of an ice making device which are viewed from a rear side.
Figure 7B:
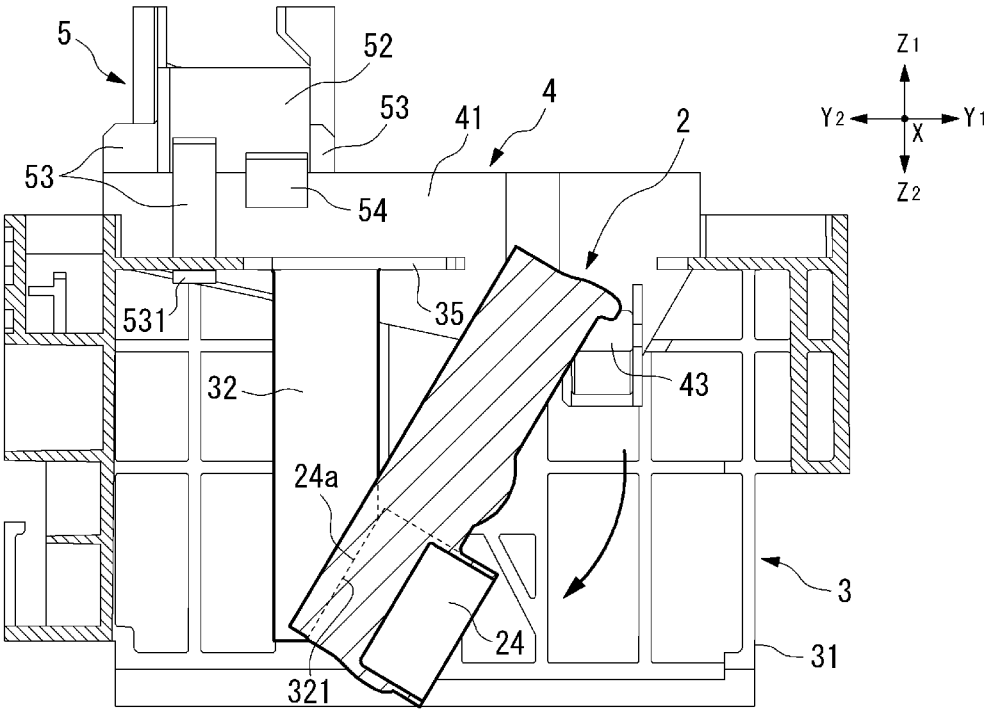

FIG. 7A and FIG. 7B are cross-sectional views for explaining an ice separating operation of the ice making device "U" which are viewed from the rear side. FIG. 7A is a view showing a state that the ice tray 2 is located horizontally and FIG. 7B is a view showing a position of the ice tray 2 at a time of an ice separating operation.

The wall part 31 of the frame 3 is provided with a rib 32 in a plate shape which is extended in the upper and lower direction. A lower end of the rib 32 is formed with a block part 321 which contacts with a bottom face 24*a* of the water receiving part 24 during turning of the ice tray 2 and partly disturbs turning of the ice tray 2. An ice separating mechanism in this embodiment is structured of the block part 321 and the drive unit 1 structured to turn the ice tray 2.

A control device of the refrigerator-freezer operates the drive unit 1 for starting an ice separating operation when a temperature of the ice tray 2 has reached a predetermined value and it is detected that ice pieces have been made. The drive unit 1 lowers the ice detection arm 12 in an inside of the ice storage container to inspect an ice quantity before the ice tray 2 is turned and, after confirmed that a space in the ice storage container has an enough spatial margin, the drive unit 1 turns the ice tray 2 in a clockwise direction in FIG. 7A.

When the ice tray 2 is turned by a predetermined amount, the bottom face 24*a* of the water receiving part 24 contacts with an opposing face of the block part 321. The drive unit 1 further turns the ice tray 2 from that position to deform the ice tray 2 so as to be twisted. As a result, ice pieces in the ice tray 2 are pushed out from the respective cells 21 and drop into the ice storage container disposed under the ice making device "U".

The rib 32 in this embodiment is a part of the wall part 31 and the block part 321 is a lower end portion of the rib 32. Therefore, when the ice tray 2 is contacted with the block part 321 and is twisted, a considerable force is applied to the wall part 31. In this embodiment, the water passage part 4 is integrated with an upper part of the wall part 31 and thus, the rigidity in the upper and lower direction of the wall part 31 is increased by the side wall part 41 provided in the water passage part 4. Further, the block part 321 is disposed under the water passage part 4 (side wall part 41). Therefore, distortion of the frame 3 occurred when the ice tray 2 is pressed against the block part 321 is reduced.

After ice pieces have been taken out from the ice tray 2, the drive unit 1 turns the ice tray 2 in a counterclockwise direction in FIG. 7B to return the ice tray 2 to a horizontal posture. When the control device of the refrigerator-freezer detects that a series of the ice separating operations has been completed, the ice tray 2 is filled with water again.

Modified Embodiments

Figure 8:
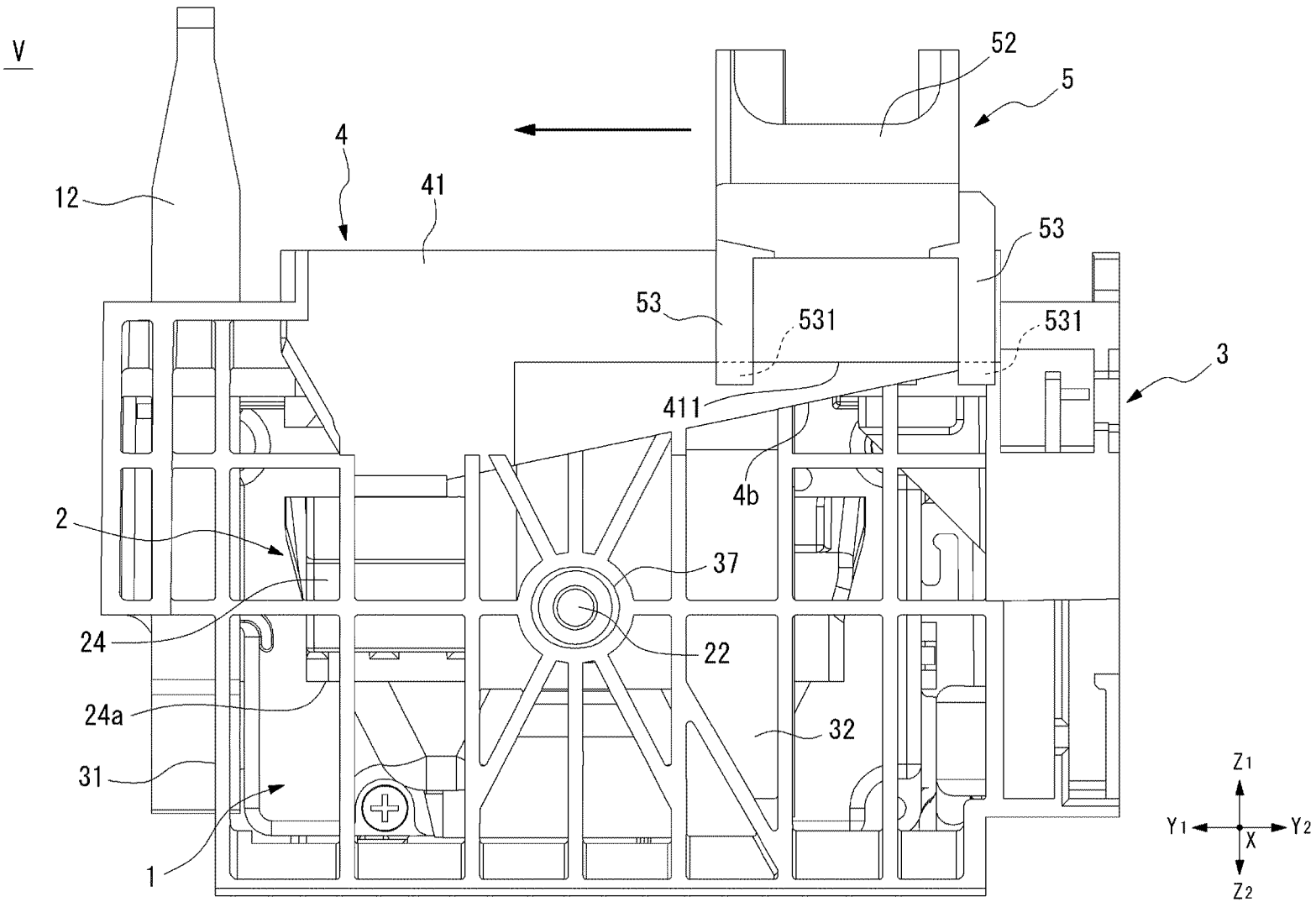
FIG. 8 is a front view showing an ice making device in accordance with a modified embodiment of the present invention.

FIG. 8 is a front view showing an ice making device "V" which is a modified embodiment of the present invention. In the following descriptions, the same reference signs are used in the similar or the same structures as the above-mentioned embodiment and their descriptions are omitted.

In the ice making device "U" in the embodiment described above, an attaching position of the water supply adapter 5 on the frame 3 is fixed. However, in an ice making device "V" in this modified embodiment, a degree of freedom of an attaching position of the water supply adapter is enhanced.

The water supply port 44 is not provided in the water passage part 4 in this modified embodiment. An outer face of the water passage part 4 in this modified embodiment is formed with a rail part 411 which is extended in the right and left direction. The rail part 411 is a recessed portion in which the side wall part 41 of the water passage part 4 is recessed in a step shape. In FIG. 8, only a front side of the water passage part 4 is shown, but a similar rail part 411 is also formed on a rear face side of the water passage part 4.

In the water supply adapter 5 in this modified embodiment, both of arm parts 53 formed on the right and left faces have the same length, and the hooks 531 of the arm parts 53 are engaged with the rail part 411. In FIG. 8, only the front side of the water supply adapter 5 is shown, but two arm parts 53 are also formed on a rear face of the water supply adapter 5 so that the hooks 531 are engaged with the corresponding rail part 411. In this modified embodiment, no arm part 54 is provided on the rear face of the water supply adapter 5. Further, the arm parts 53 on the rear face of the water supply adapter 5 are not passed through holes of the rib 35 and can be freely moved in the right and left direction. As a result, the water supply adapter 5 is structured so that its attaching position can be slid in the right and left direction along the rail part 411.

As described above, the water supply adapter 5 in this modified embodiment is structured to be slidable along the slope 42 of the water passage part 4 in the right and left direction and thus, an attaching position of the water supply adapter 5 can be flexibly and finely adjusted according to a specification of a freezing chamber to be installed.

Although the present invention has been shown and described with reference to a specific embodiment, various changes and modifications will be apparent to those skilled in the art from the teachings herein. For example, the ice making device "U" in the above-mentioned embodiment is a twisting type ice making device, but a combination of the water passage part 4 provided in the frame 3 and the water supply adapter 5 can be applied to a so-called scraping-out type ice making device structured to take out ice pieces so as to scrape out from the cells 21 without twisting the ice tray 2.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ice making device comprising:

an ice tray;

an ice separating mechanism structured to take out ice pieces from the ice tray, wherein the ice separating mechanism comprises a block part;

a drive part structured to drive the ice separating mechanism, wherein the drive part comprises a motor; and a frame which supports the ice tray and the drive part;

wherein the frame comprises a water passage part which guides water supplied from an outside to the ice tray, wherein the frame is attached with a water supply adapter which is separately provided from the water passage part for supplying the water to the water passage part, wherein the water passage part comprises a water passage port through which the water is poured into the ice tray and a slope which is an inclined face for sending the water to the water passage port, and wherein the water supply adapter supplies the water to the slope, and is structured so that an attaching position of the water supply adapter to the frame is capable of sliding along the slope.

2. The ice making device according to claim 1, wherein the water supply adapter comprises a water discharge part which is disposed on the water passage part and a water receiving part which is disposed so as to protrude from the frame to an outer side.

3. The ice making device according to claim 1, wherein the water supply adapter is capable of being attached to a plurality of different positions on the frame.

4. The ice making device according to claim 1, wherein the water passage part further comprises a water supply port which is a water passage protruded to an outer side of the frame from a middle of the slope, and the water supply adapter is attached to an upstream side of the slope with respect to a position where the water supply port is formed.

5. The ice making device according to claim 1, wherein the water passage part comprises a side wall part which is a side wall of a water passage, the ice separating mechanism comprises:

the drive part structured to turn the ice tray to be reversed; and the block part structured to contact with a part of the ice tray during turning and obstruct partly the turning of the ice tray, and the water passage part and the block part are integrated with the frame and the block part is provided under the water passage part.

6. An ice making device comprising:

an ice tray;

an ice separating mechanism structured to take out ice pieces from the ice tray, wherein the ice separating mechanism comprises a block part;

a drive part structured to drive the ice separating mechanism, wherein the drive part comprise a motor; and a frame which supports the ice tray and the drive part, wherein the frame comprises a water passage part which guides water supplied from an outside to the ice tray, the frame is attached with a water supply adapter which is separately provided from the water passage part for supplying the water to the water passage part, the water passage part comprises a water passage port through which the water is poured into the ice tray and a slope which is an inclined face for sending the water to the water passage port, the water supply adapter comprises an arm part which is elastically deformable, the arm part comprises a first fitting part which is a hook, a hole or a recessed part, the frame comprises a second fitting part in a shape to be paired with the first fitting part, and the water supply adapter is attached to the frame by fitting the first fitting part and the second fitting part to each other.

* * * * *